United States Patent [19]

Fearnhead

[11] Patent Number: 4,642,261

[45] Date of Patent: Feb. 10, 1987

[54] PAPERMAKERS FABRIC HAVING A TIGHT BOTTOM WEFT GEOMETRY

[75] Inventor: Ivan J. Fearnhead, Shreveport, La.

[73] Assignee: Unaform Inc., Shreveport, La.

[21] Appl. No.: 685,129

[22] Filed: Dec. 21, 1984

[51] Int. Cl.[4] ..... D03D 3/00

[52] U.S. Cl. ..... 428/225; 28/158; 139/383 A; 162/DIG. 1; 428/229; 428/257

[58] Field of Search ..... 139/383 A; 162/DIG. 1; 428/229, 230, 257, 258, 259, 225; 28/158, 163

[56] References Cited

U.S. PATENT DOCUMENTS

| | | | |
|---|---|---|---|
| 24,007 | 5/1955 | Foster | 28/158 |
| 3,553,066 | 1/1971 | Cavalier et al. | 428/229 |
| 4,107,371 | 8/1978 | Dean | 428/257 |
| 4,182,381 | 1/1980 | Gisbourne | 139/425 A |
| 4,359,069 | 11/1982 | Hahn | 139/425 A |
| 4,408,638 | 10/1983 | Strom | 428/257 |
| 4,467,839 | 8/1984 | Westhead | 428/259 |
| 4,517,687 | 5/1985 | Liebig et al. | 428/229 |

*Primary Examiner*—James J. Bell

*Attorney, Agent, or Firm*—Fleit, Jacobson, Cohn & Price

[57] ABSTRACT

A two-face, double-layer forming fabric having a tight bottom weft geometry. The fabric, in general, comprises first and second pluralities of cross-machine direction yarns and a plurality of machine direction yarns interwoven in accordance with a desired weave pattern to define a top layer and a bottom layer. The top layer, which receives paper stock, is defined by the first plurality of cross-machine direction yarns. The bottom layer, which contacts machine rolls, is defined by the second plurality of cross-machine direction yarns. The second plurality of yarns are heat shrinkable.

In one embodiment of the fabric, all machine direction yarns are woven in an 8-shaft weave to provide a $\frac{1}{3}$ twill on the top layer and a 1/7 twill on the bottom layer. The cross-machine direction floats formed by this weave pattern are flattened during heat treatment of the fabric because of shrinkage of the bottom layer cross-machine direction yarns.

14 Claims, 4 Drawing Figures

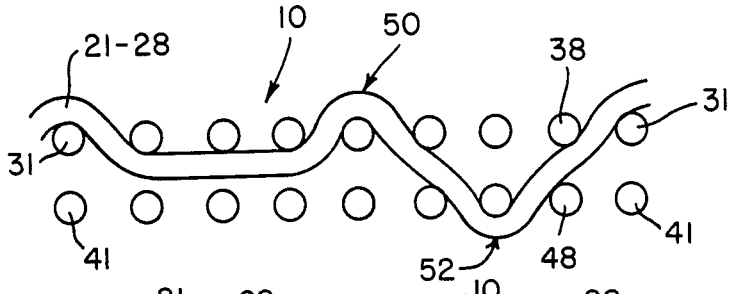
FIG. 1
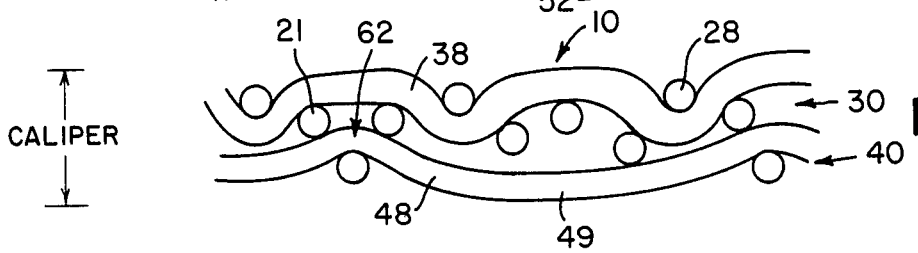
FIG. 2
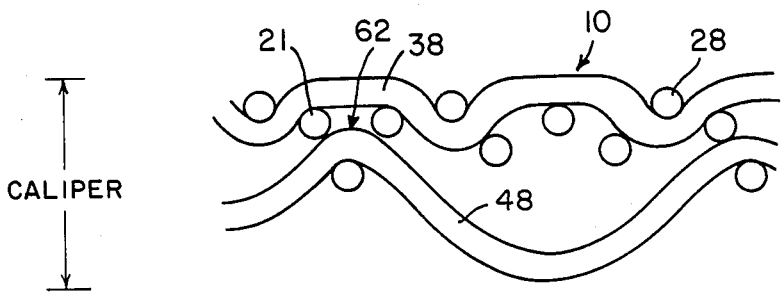
FIG. 4
PRIOR ART
| | 28 | 27 | 26 | 25 | 24 | 23 | 22 | 21 | |
|---|---|---|---|---|---|---|---|---|---|
| 31 | X | | | | X | | | | L |
| 41 | X | X | X | X | X | X | | X | H |
| 32 | | | | X | | | | X | L |
| 42 | X | | X | X | X | X | X | X | H |
| 33 | | | X | | | | X | | L |
| 43 | X | X | X | X | | X | X | X | H |
| 34 | | X | | | | X | | | L |
| 44 | X | X | X | X | X | X | X | | H |
| 35 | X | | | | X | | | | L |
| 45 | X | X | | X | X | X | X | X | H |
| 36 | | | | X | | | | X | L |
| 46 | X | X | X | X | X | | X | X | H |
| 37 | | | X | | | | X | | L |
| 47 | | X | X | X | X | X | X | X | H |
| 38 | | X | | | | X | | | L |
| 48 | X | X | X | | X | X | X | X | H |
FIG. 3
L = LOW SHRINK YARN
H = HIGH SHRINK YARN

PAPERMAKERS FABRIC HAVING A TIGHT BOTTOM WEFT GEOMETRY

BACKGROUND OF THE INVENTION

1. Field of the Invention

The subject invention relates to papermakers fabrics, in general, and to a double layer forming fabric having a tight bottom weft geometry, in particular.

2. Description of the Prior Art

In papermaking machines, paper stock, also called furnish or stuff, is fed onto the top surface or outer face of a traveling, endless, papermaking belt which serves as the papermaking surface of the machine. The bottom surface or inner face of the endless belt is supported on and driven by rolls associated with the machine. The papermaking belt, also known as Fourdrinier wire, forming medium, or forming fabric, is commonly configured from a length of woven fabric having its ends joined together in a seam to provide an endless belt. The fabric may also be constructed by employing an endless-weave process thereby eliminating the seam. Either fabric generally comprises a plurality of machine-direction yarns and a plurality of cross-machine-direction yarns which have been woven together on a suitable loom.

Initially, forming fabrics were woven-wire structures made from materials such as phosphor bronze, bronze, stainless steel, brass, or suitable combinations thereof. Recently in the papermaking field, it has been found that synthetic materials may be used, in whole or in part, to produce forming fabrics of superior quality. Today almost all forming fabrics are made from the following: polyester fibers, such as Dacron or Trevira; acrylic fibers, such as Orlon, Dynel and Acrilan; copolymers, such as Saran; or polyamides, such as Nylon. The warp and weft yarns of the forming fabrics may be of the same or different constituent materials and/or constructions and may be of monofilament or multifilament yarn of either circular or noncircular cross section.

In the prior art, numerous double-layer forming fabrics have been made by employing various 8- and 10-shaft weave designs. For example, see U.S. Pat. Nos. 4,182,381 and 4,359,069. These fabrics tend to have shortcomings related to the weave structure. A paper sheet coming off a papermakers fabric is wetter than would be expected from the apparent drainage rate designed into the fabric. Also fabric life tends to be lower than would be expected given the weave structure and the size of the yarns used.

Many of the prior-art forming fabrics employ cross-machine direction or weft floats on either the outer or the inner surface. As used herein, a float is a portion of a weft yarn that passes over (or under) two or more warp yarns, or it is a portion of a warp yarn that passes over (or under) two or more weft yarns before interweaving. For example, a weft or cross-machine direction yarn that passes over three warp or machine direction yarns before interweaving will be referred to herein as a three-float. These cross-machine direction floats when present on the inner surface of the fabric are quite loosely bound into fabric.

Two known fabrics employing a low-density double layer are made of an 8 shaft weave and a 10 shaft weave. The most notable difference between the two is that the cross-machine or weft yarns in the 8-shaft weave are stacked vertically, whereas the yarns in the 10-shaft weave are offset. It has been noticed in these types of fabrics that there are drainage problems which cause the resultant paper web to be too wet as it comes off the fabric. It has also been observed that such fabrics tend to exhibit a shorter fabric life than should be expected.

In studying these fabrics, especially the 8-shaft design, it has been noted that the machine-side weft yarns have a pronounced crimp which pulls the weft out of contact with the warp yarns except at the weft knuckles. As used herein, a knuckle is a one-float. The bottom weft is therefore bound quite loosely and exhibits what might be termed a loose bottom weft geometry. The resulting large gap between the bottom-weft floats and the warp yarns makes it difficult to get a good vacuum seal over the papermaking machine's suction boxes, rollers, etc. It is also apparent that the shape of the bottom-weft float leads to a high degree of wear at the center of the float and, hence, a poor life for the resultant fabric.

The loose bottom wefts occur on all fabrics which are woven from standard yarns since, during the heat-setting process when crimp interchange is taking place, the top-weft yarns have more crimps per unit length of yarn, thus forcing the bottom-weft yarns to take on a more pronounced crimp and move away from the warp yarns except at the crimp interchange.

It is toward solving or minimizing the prior-art problems that the present invention is directed

SUMMARY OF THE INVENTION

The subject invention relates to a two-face, double-layer forming fabric having a tight bottom weft geometry. The fabric, in general, comprises first and second pluralities of cross-machine direction (weft) yarns and a plurality of machine direction (warp) yarns interwoven in accordance with a desired weave pattern to define a top layer and a bottom layer. The top layer which has a paper receiving surface is defined by the first plurality of cross-machine direction yarns. The bottom layer which has a machine-roll contacting surface is defined by the second plurality of cross-machine direction yarns. The second plurality of yarns is heat shrinkable to a much greater degree than the first plurality of weft yarns.

In one embodiment of the fabric, all machine direction yarns are woven in an 8-shaft weave to provide a $\frac{1}{3}$ twill on the top layer and a 1/7 twill on the bottom layer. The cross-machine direction floats of the bottom layer formed by this weave pattern are flattened during heat treatment of the fabric because of shrinkage of the bottom-layer weft or cross-machine direction yarns.

A fabric embodying the subject invention can be woven with thicker cross-machine direction yarns thereby further strengthening the fabric and presenting a greater surface to balance the support area required for sheet smoothness on the outer surface with an increase in the wearing surface or the inner face to provide longer useful fabric life.

It is, therefore, an object of the present invention to provide a forming fabric in which drainage and wear problems are kept to a minimum without sacrificing the quality of the finished paper.

It is another object of the present invention to provide a forming fabric with increased wire life characteristics.

It is yet another object of the present invention to provide a forming fabric which exhibits improved fines retention, because the size of the interstices between the yarns is controlled by the presence of a tight bottom weft geometry.

Additional objects of the present invention will become apparent from a reading of the appended specification and claims in which preferred, but not necessarily the only, forms of the invention will be described in detail, taken in connection with the drawings accompanying and forming a part of the application.

BRIEF DESCRIPTION OF THE DRAWINGS

FIG. 1 is a transverse schematic section for viewing in the cross-machine direction of a fabric embodying the teachings of the present invention.

FIG. 2 is a transverse schematic section for viewing in the machine direction of the fabric of FIG. 1.

FIG. 3 is a diagram of the weave pattern for generating the fabric of FIG. 1.

FIG. 4 is a transverse schematic section for viewing in the machine direction of the fabric of FIG. 1 produced according to the prior art.

DETAILED DESCRIPTION OF THE PREFERRED EMBODIMENT

In describing the preferred embodiments of the present invention as illustrated in the drawings, specific terminology will be resorted to, for the sake of clarity. However, the invention is not intended to be limited to the specific terms so selected, and it is to be understood that each specific term includes all technical equivalents which operate in a similar manner to accomplish a similar purpose.

With reference to FIGS. 1 through 4, there is generally shown a forming fabric 10 made up of a plurality of warp yarns 21 through 28 interwoven with a plurality of weft yarns 31 through 38 and 41 through 48 in an 8 shaft-weave design. The weave pattern for the weave design of a preferred embodiment is shown with reference to FIG. 3.

The first plurality of weft yarns or cross-machine direction yarns 31 through 38 define a plane 30. With regard to the position of intended use of the forming fabric, plane 30 constitutes a top plane or top layer. The second plurality of weft yarns 41 through 48 define a second plane 40. Again with regard to the position of intended use of the fabric, plane 40 may be referred to as a bottom plane or bottom layer.

The machine direction or warp yarns 21 through 28 are interwoven with the weft yarns 31 through 38 and define a top surface which acts as a paper-stock-receiving surface 50. The machine direction yarns 21 through 28 are interwoven with the second plurality of weft yarns 41 through 48 to define a machine-element or machine-roll contacting surface 52.

In a preferred embodiment, the warp yarns 21 through 28 have a diameter of 0.27 millimeters and are made of high-modulus polyester monofilament that is substantially inextensible. The weft yarns 31 through 38 in the first layer 30 have a diameter of 0.35 millimeters and are made of low-heat-shrinkage polyester monofilament that is substantially inextensible. Such weft yarns of polyester monofilament have a heat shrinkage at 200° C. within the range of about 3% to 6%. Likewise, the weft yarns 41 through 48 in the bottom layer 40 have a diameter of 0.35 millimeters and are made of high heat-shrinkage polyester monofilament. Such yarns of polyester monofilament have a heat shrinkage at 200° C. within the range of about 8% to 20%. Thus the weft yarns 41 through 48 exhibit a high degree of shrinkage when compared with weft yarns 31 through 38.

In a fabric woven according to the prior art (FIG. 4), the warp yarns 21 through 28 are made of high-modulus polyester monofilament. The weft yarns 31 through 38 in the first layer 30 are made of low heat-shrinkage polyester monofilament. Likewise, the weft yarns 41 through 48 in the bottom layer 40 are made of low heat-shrinkage polyester monofilament.

Weft yarns of the type noted above are used for flat-woven fabrics because they provide control during the weaving process and, due to their low heat shrinkage, are more easily controlled during the heat-setting process which follows the weaving process.

FIG. 4 shows in transverse cross section a portion of the fabric 10 produced according to the prior art. As can be seen, the bottom weft or cross-machine direction yarn 48 is bound quite loosely within the fabric. Further, it may be noted that the yarn has a pronounced crimp which acts to pull the weft yarn 48 out of contact with the warp yarns except at the knuckle 62.

FIG. 2 shows in transverse cross section a portion of a fabric 10 embodying the teachings of the subject invention. During a conventional heat setting process, the bottom weft or cross-machine direction yarn 48 shrinks and acts to pull the crimp closer to the warp yarns 21 through 28. The resultant crimp is much flatter and presents a much larger wear surface to the paper machine's elements. The same shrinking and crimp pulling takes place with the other cross-machine direction yarns 41 through 47.

A test was conducted to illustrate the dramatic difference in caliper between a prior-art fabric, such as that in FIG. 4, and a fabric embodying the teachings of the present invention as shown in FIG. 2.

SAMPLE 1

A fabric was woven using warp or machine direction yarns of high-modulus polyester with a diameter of 0.27 millimeters at 50 ends per inch in the loom. Top and bottom weft or cross-machine direction yarns of polyester with a heat shrinkage of 3% to 6% at 200° C. were inserted at 80 picks per inch (PPI)—40 top, 40 bottom—in the loom. The fabric was woven using the weave diagram shown in FIG. 3. The fabric was heat set using standard procedures to obtain the required stability for operation on a paper machine. The finished specifications for the fabric showed the mesh to be 59×74 and the fabric thickness or caliper to be 0.052 inches.

SAMPLE 2

A fabric was woven according to the procedure followed to make the sample 1 fabric except that the bottom weft or cross-machine direction yarns 41 through 48 were made of polyester with a heat shrinkage of 8% to 20% at 200° C. The fabric was heat set using standard procedures to obtain the required stability for operation on the paper machine. The finished specifications for the fabric showed the mesh to be 60×74 and the fabric thickness or caliper to be 0.047 inches.

The reduction in caliper from sample 1 to sample 2 is significant because it has come from a pronounced flattening of the float associated with each of the bottom-weft yarns 41 through 48 by providing the tight bottom weft geometry such as that shown in FIG. 2. The resultant fabric exhibits a much longer wearing surface on each bottom-weft float 49 and also pulls the bottom weft into contact with the warp yarns. In this way the major flaws of fabric manufactured using the prior art are corrected.

It is to be understood that the embodiments previously described are by way of illustration only and that other fabrics may benefit from the teachings of the subject invention. In particular, any forming fabric which contains a tight bottom weft geometry will produce a fabric in which the problems associated with poor drainage and fabric wear are substantially reduced. Further, the fabric will exhibit a greater-life characteristic because the cross-machine direction float arrangement provides a large support area for the fabric when contacting the machine parts.

Obviously, many modifications and variations of the present invention are possible in light of the above teachings, and it is contemplated that, within the scope of the appended claims, the invention may be practiced otherwise than as specifically described.

What is claimed:

1. A papermakers fabric comprising a duplex fabric having a plurality of machine direction yarns and cross-machine direction yarns interwoven in accordance with a desired weave pattern, a top layer defined by a first plurality of said cross-machine direction yarns and a bottom layer defined by a second plurality of said cross-machine direction yarns, said yarns of said second plurality having a higher heat shrinkage than said yarns of said first plurality and being contracted heat-shrinkable yarns after heat setting of the fabric.

2. The fabric of claim 1, wherein only the second plurality of cross-machine direction yarns are heat shrinkable yarns.

3. The fabric of claim 2, wherein said heat-shrinkable yarns are polyester monofilament yarns having a heat shrinkage at 200° C. within the range of about 8% to 20%.

4. The fabric of claim 3, wherein said first plurality of cross-machine direction yarns is made up of polyester monofilament yarns having a heat shrinkage at 200° C. within the range of about 3% to 6%.

5. The fabric of claim 4, further comprising a plurality of warp yarns interwoven with said first and second pluralities of cross-machine direction yarns, said warp yarns being made of polyester monofilament yarns having a heat shrinkage at 200° C. within the range of about 8% to 20%.

6. A papermaker's fabric comprising:

a plurality of first weft yarns;

a plurality of second weft yarns; and a plurality of warp yarns interwoven with said first and second weft yarns in accordance with a preselected weave pattern in which said first weft yarns define a top layer and said second weft yarns define a bottom layer, a select number of said second weft yarns having a higher heat shrinkage than said first weft yarns and being contracted heat-shrinkable yarns after heat setting of the fabric.

7. A multilayer forming fabric comprising:

a plurality of substantially inextensible first cross-machine direction yarns lying substantially in a first plane to define a top layer;

a plurality of contracted shrinkable second cross-machine direction yarns lying substantially in a second plane to define a bottom layer, said second yarns having a higher heat shrinkage than said first yarns; and a plurality of substantially inextensible machine direction yearns interwoven with said pluralities of inextensible and contracted, shrinkable cross-machine direction yarns in accordance with a predetermined weave pattern.

8. The fabric of claim 7, wherein said shrinkable yarns are heat-shrinkable yarns.

9. The fabric of claim 7, wherein said predetermined weave pattern produces a $\frac{1}{3}$ twill on said top layer and 1/7 twill on said bottom layer.

10. The fabric of claim 1, wherein the fabric includes floats on said bottom layer.

11. The fabric of claim 6, wherein the fabric includes floats on said bottom layer.

12. The fabric of claim 7, wherein the fabric includes floats on said bottom layer.

13. A method of making a forming fabric comprising the steps of:

arranging a plurality of substantially inextensible cross-machine direction yarns in substantially the same first plane to define a forming fabric top layer;

arranging a plurality of heat-shrinkable cross-machine direction yarns in substantially the same second plane to define a forming fabric bottom layer;

interweaving a plurality of substantially inextensible machine direction yarns with said pluralities of inextensible and heat-shrinkable yarns in accordance with a predetermined weave pattern; and subjecting the interwoven yarns to a heat setting treatment to heat set said fabric for a time until said shrinkable yarns have shrunk to press up against the machine direction yarns.

14. The method of claim 13, wherein the fabric includes floats on said bottom layer.

* * * * *